US010119264B2

(12) United States Patent
Xiao et al.

(10) Patent No.: US 10,119,264 B2
(45) Date of Patent: Nov. 6, 2018

(54) AIR-SUPPORTED MEMBRANE STRUCTURE DOME AND FOUNDATION THEREOF

(71) Applicant: BROADWELL (SHENZHEN) TECHNOLOGY CO., LTD, Shenzhen, Guangdong (CN)

(72) Inventors: Long Xiao, Guangdong (CN); Hongyi Ding, Guangdong (CN); Xiudong Wei, Guangdong (CN); Maozhang Huang, Guangdong (CN)

(73) Assignee: BROADWELL (SHENZHEN) TECHNOLOGY CO., LTD, Shenzhen, Guangdong (CN)

( * ) Notice: Subject to any disclaimer, the term of this patent is extended or adjusted under 35 U.S.C. 154(b) by 0 days.

(21) Appl. No.: 15/521,832

(22) PCT Filed: Dec. 25, 2015

(86) PCT No.: PCT/CN2015/098839
§ 371 (c)(1),
(2) Date: Apr. 25, 2017

(87) PCT Pub. No.: WO2016/101907
PCT Pub. Date: Jun. 30, 2016

(65) Prior Publication Data

US 2017/0254064 A1 Sep. 7, 2017

(30) Foreign Application Priority Data

Dec. 26, 2014 (CN) ..... 2014 1 0840663

(51) Int. Cl.
*E04B 1/16* (2006.01)
*E02D 27/32* (2006.01)
(Continued)

(52) U.S. Cl.
CPC ..... *E04B 1/169* (2013.01); *E02D 27/32* (2013.01); *E04B 1/34321* (2013.01); *E04H 3/14* (2013.01);
(Continued)

(58) Field of Classification Search
CPC ..... E04G 11/045; E04B 1/169; E04B 1/3211; E04B 1/168; E04B 1/32; E04H 15/20; E04H 15/22
(Continued)

(56) References Cited

U.S. PATENT DOCUMENTS 3,462,521 A * 8/1969 Bini ..... E04B 1/169 249/63
3,643,910 A * 2/1972 Heifetz ..... E04B 1/169 249/13
(Continued)

FOREIGN PATENT DOCUMENTS

CN 1526044 9/2004
CN 203222807 10/2013
(Continued)

OTHER PUBLICATIONS

International Search Report for international application No. PCT/CN2015/098839, dated Apr. 1, 2016 (6 pages, including English translation).

*Primary Examiner* — Gisele D Ford
(74) *Attorney, Agent, or Firm* — Hamre, Schumann, Mueller & Larson, P.C.

(57) ABSTRACT

An air dome foundation comprises multiple foundation modules (110). The multiple foundation modules (110) are used to be placed on the ground end to end. The foundation modules (110) comprise straight structure and L-shaped structure. The foundation is low in construction cost, short in construction period and suitable for always moving or the
(Continued)

situation in which original ground surface can not be modified or damaged.

6 Claims, 6 Drawing Sheets

(51) Int. Cl.

| | |
|---|---|
| ***E04B 1/343*** | (2006.01) |
| ***E04H 3/14*** | (2006.01) |
| *E04B 1/00* | (2006.01) |
| *E04H 3/10* | (2006.01) |
| *E04H 15/20* | (2006.01) |
| *E04H 15/22* | (2006.01) |

(52) U.S. Cl.
CPC ..... *E04B 1/16* (2013.01); *E04B 1/343* (2013.01); *E04B 2001/0053* (2013.01); *E04H 3/10* (2013.01); *E04H 15/20* (2013.01); *E04H 15/22* (2013.01); *E04H 2015/203* (2013.01)

(58) Field of Classification Search
USPC ..... 52/294
See application file for complete search history.

(56) References Cited

U.S. PATENT DOCUMENTS 3,719,341 A * 3/1973 Harrington ..... E04B 1/169 249/65
4,041,671 A * 8/1977 Nicholson ..... E04B 1/166 52/2.15
4,064,663 A * 12/1977 Moss ..... E04B 1/166 52/309.9
4,192,105 A * 3/1980 Morgan ..... E04H 15/20 52/2.25
4,629,592 A * 12/1986 Harrington ..... E04G 11/04 249/19
5,177,919 A * 1/1993 Dykmans ..... B65D 88/34 405/229
5,195,293 A * 3/1993 diGirolamo ..... E04B 1/24 52/745.13
5,586,841 A * 12/1996 Anderson ..... B29C 49/2408 405/286
5,918,438 A * 7/1999 South ..... E04B 1/169 264/32
8,302,357 B1 * 11/2012 Nolte ..... E02D 31/002 52/220.2
9,695,585 B1 * 7/2017 Seiford, Sr. ..... E04B 1/3211
2004/0045227 A1 * 3/2004 South ..... E04B 1/169 52/80.1
2008/0072501 A1 * 3/2008 Ligas ..... E04H 9/06 52/2.25
2009/0320380 A1 * 12/2009 Chelf ..... A01G 9/1407 52/2.11
2011/0252722 A1 * 10/2011 Laurin ..... E02D 27/32 52/126.6

FOREIGN PATENT DOCUMENTS

| | | |
|---|---|---|
| CN | 103510620 | 1/2014 |
| CN | 204385756 | 6/2015 |
| KR | 20100085425 | 7/2010 |
| KR | 20120006062 | 8/2012 |

* cited by examiner

AIR-SUPPORTED MEMBRANE STRUCTURE DOME AND FOUNDATION THEREOF

FIELD OF THE INVENTION

The present disclosure relates to the field of architecture, and more particularly relates to an air-supported membrane structure dome (air dome) and a foundation thereof.

BACKGROUND OF THE INVENTION

Air dome is a building formed from one or more special architectural membranes anchored to the ground with intelligent air blowers continuously pump air into the structure and support the main structure. Air dome structures offer great flexibility, and can be used as seasonal, permanent or temporary structures, such as industrial plants, warehouses and sports venues.

Foundation is part of the building, its main function is to transfer the vertical load of the building to the ground. The conventional building foundation is subject to downward pressure, while the foundation of the air dome is subject to the upward and lateral tension of the membrane, such that air dome foundation requires a strong anti-pulling capacity, and a stable and low center of gravity.

The conventional foundation of the air dome is generally formed by pouring concrete, which needs to be deeply dug. In order to resist the pulling tension, the foundation of the air dome has a larger bottom and has to be buried underground. With respect to air dome, which is a of new low-cost, short construction cycle, and environmentally friendly construction, the cost and the construction time of the foundation accounts for a large proportion, and when the air dome is moved, the original foundation is abandoned, which will cause a lot of waste for those air dome with frequent movement.

SUMMARY OF THE INVENTION

Accordingly, it is necessary to provide an air dome and its foundation with lower construction cost.

An air dome foundation includes a plurality of foundation modules, a plurality of splicing plates, a penetrating bolt, and an anchor bolt, the anchor bolt includes a bolt head and a main body having a rod-like structure provided on the bolt head;

wherein the plurality of foundation modules are placed on the ground, the foundation module comprises an elongated structure and an L-shaped structure;

both ends of a side of the foundation module are provided with one row of first through holes, the splicing plate is provided with two rows of second through holes, the two rows of second through holes are corresponding to a row of the first through holes on an end of the two adjacent foundation modules, the penetrating bolt extends through the first through hole and the second through hole, such that two adjacent foundation modules are fixed via the splicing plate;

a bottom the foundation module is provided with a counterbore and an anchor bolt hole extending through the foundation module, the counterbore is located at an end of the anchor bolt hole and is in connection with the anchor bolt hole, the bolt head is located in the counterbore, the main body extends through the anchor bolt hole, and an end of the anchor bolt is higher than a top surface of the foundation module.

In one embodiment, the counterbore is a square dimpling, the bolt head is a square bolt head, and the end of the anchor bolt is at least 4 cm higher than the top surface of the foundation module.

In one embodiment, the air dome foundation further comprises a sealing cushion disposed between adjacent two foundation modules or on the bottom surface of the foundation module; or the air dome foundation further comprises a sealing adhesive coated between adjacent two foundation modules or on the bottom surface of the foundation module.

In one embodiment, the foundation module is a concrete foundation module.

In one embodiment, a sidewall of the foundation module is provided with at least one lifting hole and an exhaust hole.

An air dome foundation includes a plurality of foundation modules placed on a ground, wherein the plurality of foundation modules are connected end to end, the foundation module comprises an elongated structure and an L-shaped structure.

In one embodiment, the air dome foundation further comprises a plurality of splicing plates and a penetrating bolt;

both ends of a side of the foundation module are provided with one row of first through holes, the splicing plate is provided with two rows of second through holes, the two rows of second through holes are corresponding to a row of the first through holes on an end of the two adjacent foundation modules, the penetrating bolt extends through the first through hole and the second through hole, such that two adjacent foundation modules are fixed via the splicing plate.

In one embodiment, the air dome foundation further comprises an anchor bolt, the anchor bolt comprises a bolt head and a main body having a rod-like structure provided on the bolt head;

a bottom the foundation module is provided with a counterbore and an anchor bolt hole extending through the foundation module, the counterbore is located at an end of the anchor bolt hole and is in connection with the anchor bolt hole;

the bolt head is located in the counterbore, the main body extends through the anchor bolt hole, and an end of the anchor bolt is higher than a top surface of the foundation module.

In one embodiment, the counterbore is a square dimpling, the bolt head is a square bolt head.

In one embodiment, the end of the anchor bolt is at least 4 cm higher than the top surface of the foundation module.

In one embodiment, the air dome foundation further comprises a sealing cushion disposed between adjacent two foundation modules or on the bottom surface of the foundation module; or the air dome foundation further comprises a sealing adhesive coated between adjacent two foundation modules or on the bottom surface of the foundation module.

In one embodiment, the foundation module is a concrete foundation module.

In one embodiment, a sidewall of the foundation module is provided with at least one lifting hole.

In one embodiment, a sidewall of the foundation module is provided with at least one exhaust hole.

An air dome having the foregoing air dome foundation is provided.

According to the foregoing air dome foundation, the foundation module can be pre-machined in a factory, and transported to the site and installed as needed, thus achieving modularization. During installation, the foundation module can be placed on the ground without excessive treatment to the ground, such that the construction period is further shortened, and the construction costs are significantly reduced. The air dome foundation is suitable for occasions where frequent movements are needed or existing ground or facilities cannot be modified or destroyed.

DETAILED DESCRIPTION OF THE EMBODIMENTS

Figure 1:
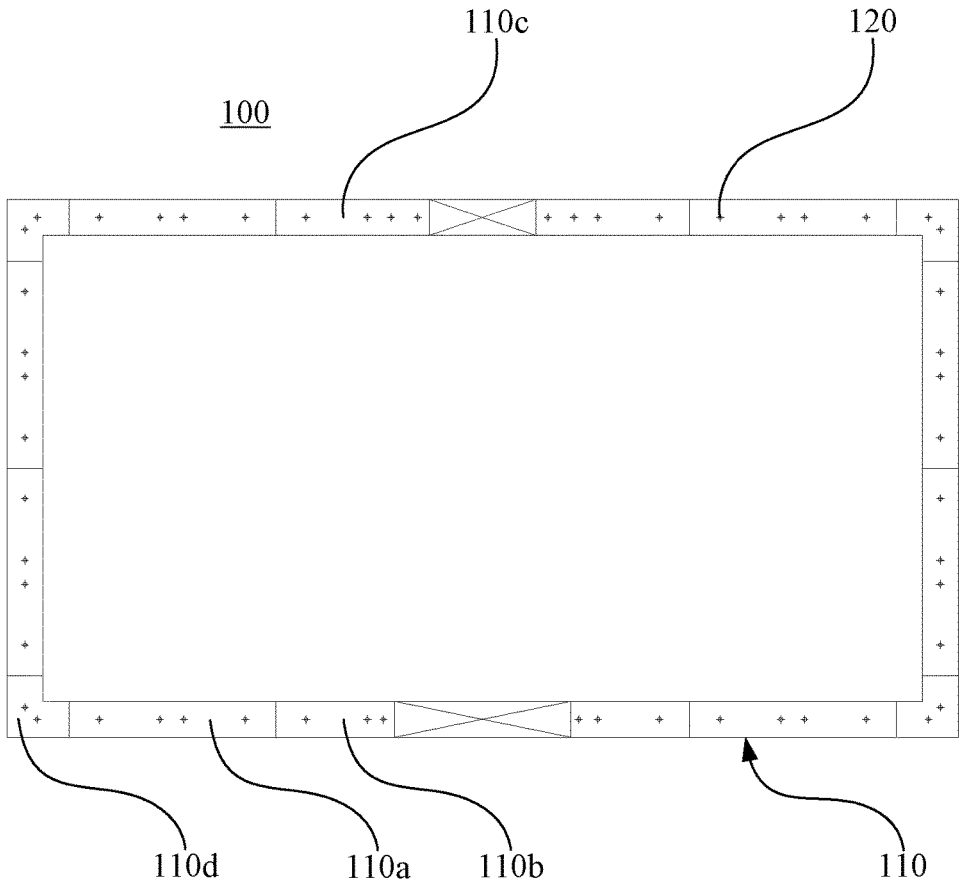
FIG. 1 is a top view of an air dome foundation according to an embodiment of the present disclosure.

Embodiments of the invention are described more fully hereinafter with reference to the accompanying drawings. The various embodiments of the invention may, however, be embodied in many different forms and should not be construed as limited to the embodiments set forth herein. Rather, these embodiments are provided so that this disclosure will be thorough and complete, and will fully convey the scope of the invention to those skilled in the art. Elements that are identified using the same or similar reference characters refer to the same or similar elements.

It will be understood that when an element is referred to as being "connected" or "coupled" to another element, it can be directly connected or coupled to the other element or intervening elements may be present. In contrast, if an element is referred to as being "directly connected" or "directly coupled" to another element, there are no intervening elements present.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Referring to FIG. 1, an air dome (not shown) according to an embodiment of the present disclosure includes an air dome foundation 100. The air dome foundation 100 includes a plurality of foundation modules 110 and a plurality of anchor bolts 120.

The foundation module 100 is placed on the ground. The plurality of foundation modules 110 are connected end to end, thus forming the illustrated annular structure.

Figure 2:
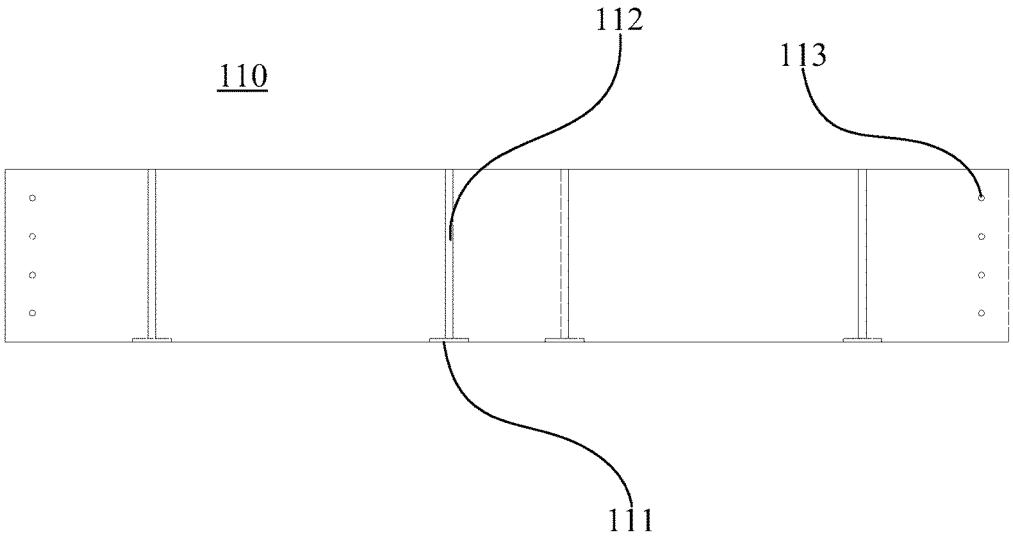
FIG. 2 is a cross-sectional view of a foundation module of the air dome foundation of FIG. 1.

Referring also to FIG. 2, a bottom the foundation module 110 is provided with a counterbore 111 and an anchor bolt hole 112 extending through the foundation module 110. The counterbore 111 is located at an end of the anchor bolt hole 112 and is in connection with the anchor bolt hole 112. Specifically, the counterbore 111 and the anchor bolt hole 112 are provided on a central axis of the bottom of the foundation module 110.

Figure 3:
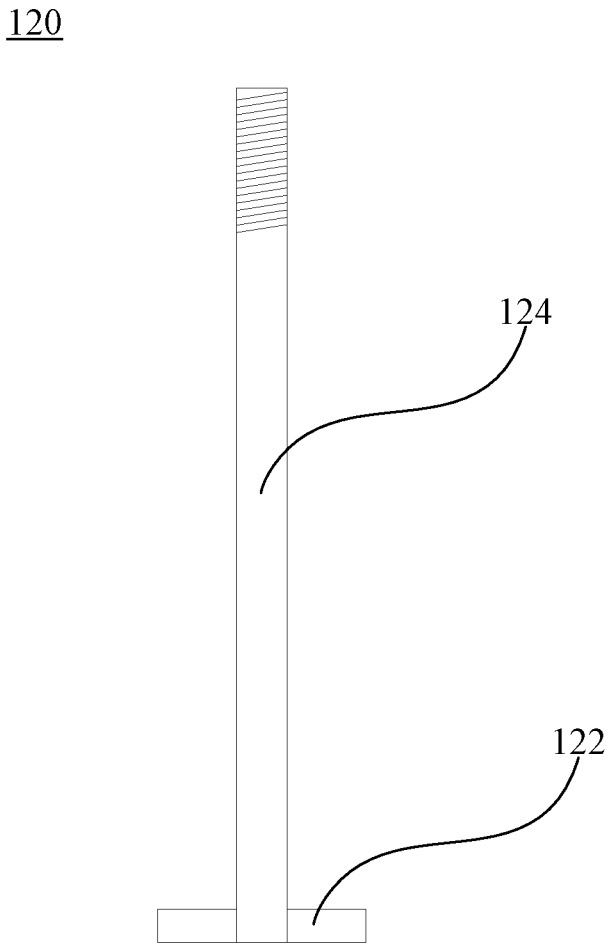
FIG. 3 is a schematic view of an anchor bolt of the air dome foundation of FIG. 1.

Referring also to FIG. 3, the anchor bolt 120 includes a bolt head 122 and a main body 124 having a rod-like structure provided on the bolt head 122. The bolt head 122 is located in the counterbore 111, the main body 124 extends through the anchor bolt hole 112, and an end of the anchor bolt 120 is higher than a top surface of the foundation module 110.

The anchor bolt 120 is a fastener configured to connect the air dome foundation 100 and membrane (not shown). An angle iron (not shown) can be placed on the foundation module 110, and the membrane is clamped between the foundation module 110 and the angle iron. The anchor bolt 120 extends through a bolt hole on the angle iron and is fastened with a nut.

Specifically, the counterbore 111 is a square dimpling, the bolt head 122 is a square bolt head. The end of the anchor bolt 120 is at least 4 cm higher than the top surface of the foundation module 110.

It should be understood that, the anchor bolt 120 may be pre-poured onto the foundation module 110. Alternatively, the anchor bolt 120 can be substituted by an expansion bolt punching into the foundation module 110 during installation. The counterbore 111 may not be limited to a square dimpling, e.g. it can be a round hole.

The foundation module 110 may be embodied as a concrete foundation module 110 pre-poured by reinforced concrete. The plurality of foundation modules 110 are connected end to end, and they can resist the upward and lateral tension of the membrane by their own weight.

According to the foregoing air dome foundation 100, the foundation module 110 thereof is modularized. The foundation module 110 can be placed on the ground without excessive treatment of the ground, even holes is not necessary to be drilled on the ground. The foundation module 110 can be pre-machined in the factory, and transported to the site and installed as needed, such that the construction period is further shortened, and the construction costs are significantly reduced.

Referring to FIG. 1 again, the foundation module 110 can include a normal side module 110*a*, a both-sides module 110*b* for main door, a both-sides module 110*c* for emergency door, and a corner module 110*d*. The normal side module 110*a*, the both-sides module 110*b* for main door, and the both-sides module 110*c* for emergency door have elongated structures. The corner module 110*d* can be of an L-shaped structure.

In the illustrated embodiment, referring to FIG. 2, both ends of a side of the foundation module 110 are provided with one row of first through holes 113.

Figure 4:
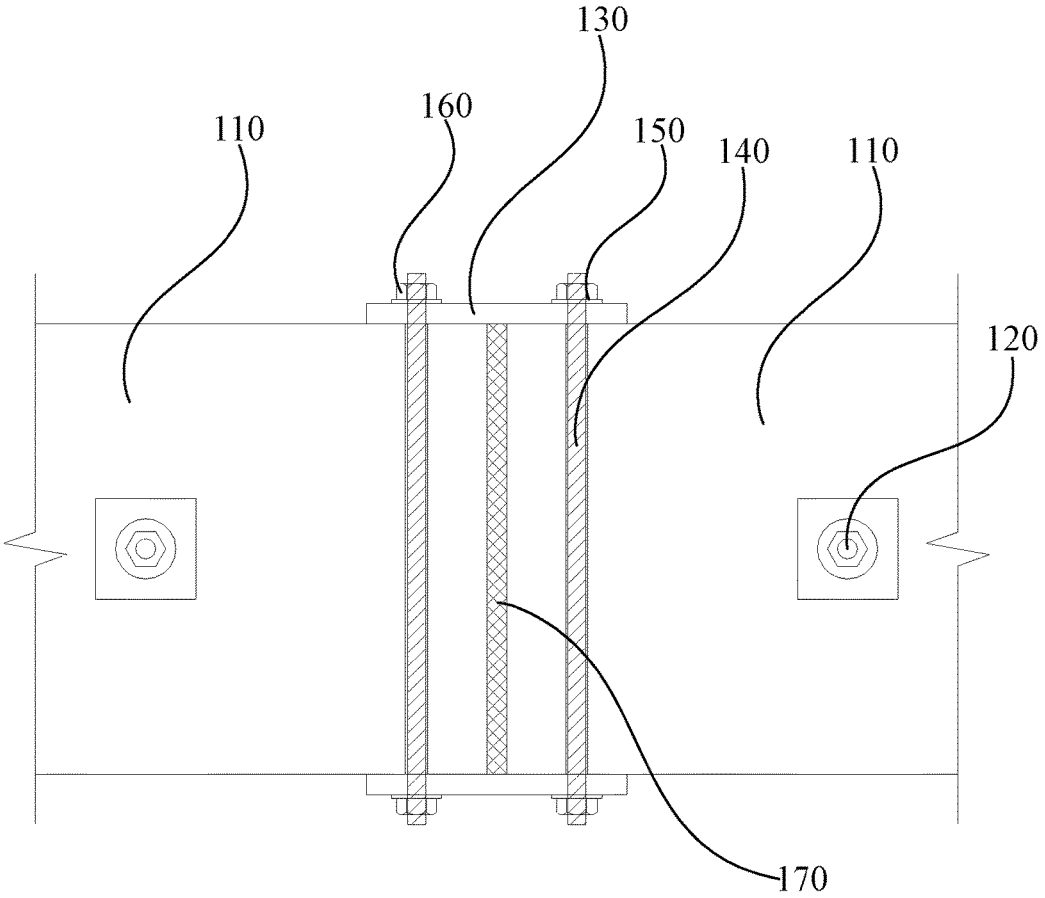
FIG. 4 is a partial schematic view of the air dome foundation of FIG. 1.
Figure 5:
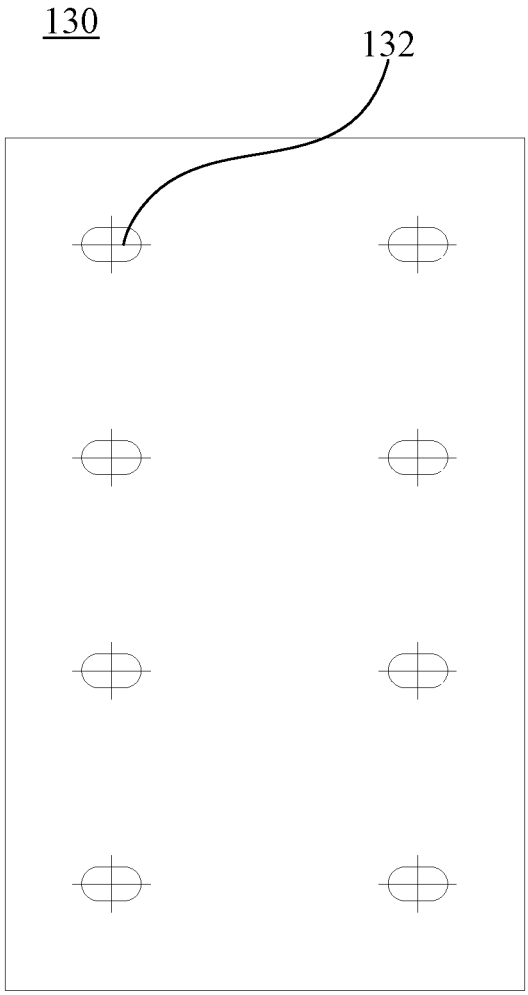
FIG. 5 is a schematic view of a splicing plate of the air dome foundation of FIG. 1.

Referring to FIG. 4 and FIG. 5, the air dome foundation 100 further includes a plurality of splicing plates 130 and penetrating bolts 140. The splicing plate 130 is provided with two rows of second through holes 132, the two rows of second through holes 132 are corresponding to a row of the first through holes 113 on an end of the two adjacent foundation modules 110. The penetrating bolt 140 extends through the first through hole 113 and the second through hole 132, such that two adjacent foundation modules 110 are fixed via the splicing plate 130.

Specifically, the second through hole 132 can be an oblong hole, so as to eliminate the dimensional error of the reserved space when the foundation module 110 is poured.

The air dome foundation 100 further includes a gasket 150 and a nut 160. The nut 160 is threadedly connected to the end of the penetrating bolt 140, so as to fasten the penetrating bolt 140. The gasket 150 is located between the nut 160 and the splicing plate 130. The penetrating bolt 140 is fastened by the nut 160 and the gasket 150.

It should be understood that, in alternative embodiments, the foundation modules 110 can be spliced by other means, besides by using the splicing plates 130 and the penetrating bolts 140.

In order to meet the sealing requirements, the air dome foundation 100 further includes a sealing cushion 170 disposed between adjacent two foundation modules 110 or on the bottom surface of the foundation module 110.

Alternatively, the air dome foundation 100 further includes a sealing adhesive coated between adjacent two foundation modules 110 or on the bottom surface of the foundation module 110. In that case, the sealing cushion 170 can be omitted accordingly.

Figure 6:
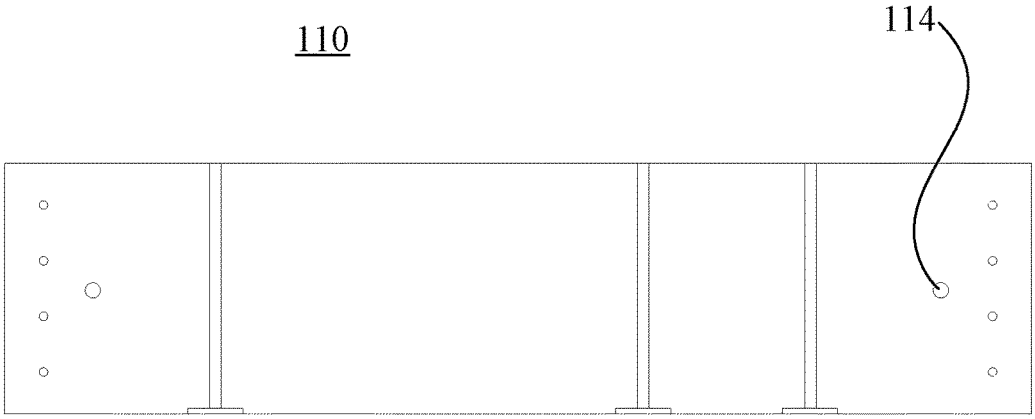
FIG. 6 is a cross-sectional view of a foundation module according to another embodiment.

Referring to FIG. 6, a sidewall of the foundation module 110 is provided with at least one lifting hole 114, so as to meet the requirement of transportation and installation. Furthermore, a sidewall of the foundation module 110 is provided with at least one exhaust hole (not shown) for exhausting or air conditioning, so as to meet the requirements of heating.

According to the foregoing air dome foundation 100, the foundation module 110 can be pre-machined in the factory, and transported to the site and installed as needed, thus achieving modularization. During installation, the foundation module 110 can be placed on the ground without excessive treatment of the ground, such that the construction period is further shortened, and the construction costs are significantly reduced. The air dome foundation 100 is suitable for occasions where frequent movements are needed or existing ground or facilities cannot be modified or destroyed.

Although the description is illustrated and described herein with reference to certain embodiments, the description is not intended to be limited to the details shown. Modifications may be made in the details within the scope and range equivalents of the claims.

What is claimed is:

1. An air dome foundation, comprising a plurality of foundation modules, a plurality of splicing plates, a penetrating bolt, and an anchor bolt, the anchor bolt comprising a bolt head and a main body having a rod-like structure;

wherein the plurality of foundation modules are placed on the ground, the plurality of foundation modules comprises elongated side modules and corner modules, wherein the corner modules are L-shaped;

both ends of a side of the foundation module are provided with one row of first through holes, the splicing plate is provided with two rows of second through holes, the two rows of second through holes are corresponding to a row of the first through holes on an end of the two adjacent foundation modules, the penetrating bolt extends through the first through hole and the second through hole, such that two adjacent foundation modules are fixed via the splicing plate;

a bottom of the foundation module is provided with a counterbore and an anchor bolt hole extending through the foundation module, the counterbore is located at an end of the anchor bolt hole and is in connection with the anchor bolt hole, the bolt head is located in the counterbore, the main body extends through the anchor bolt hole, and an end of the main body of the anchor bolt is higher than a top surface of the foundation module, wherein the end of the main body of the anchor bolt is configured to connect to a membrane of an air dome.

2. The air dome foundation according to claim 1, wherein the counterbore is a square dimpling, the bolt head is a square bolt head, and the end of the anchor bolt is at least 4 cm higher than the top surface of the foundation module.

3. The air dome foundation according to claim 1, wherein the air dome foundation further comprises a sealing cushion disposed between adjacent two foundation modules or on the bottom surface of the foundation module;

or the air dome foundation further comprises a sealing adhesive coated between adjacent two foundation modules or on the bottom surface of the foundation module.

4. The air dome foundation according to claim 1, wherein the foundation module is a concrete foundation module.

5. The air dome foundation according to claim 1, wherein a sidewall of the foundation module is provided with at least one lifting hole.

6. An air dome comprising an air dome foundation according to claim 1.

* * * * *